United States Patent [19]

Landy

[11] 4,089,571

[45] May 16, 1978

[54] GLOVE PORT AND INSERT

[76] Inventor: Jerome J. Landy, 13700 SW. 78 Ct., Miami, Fla. 33158

[21] Appl. No.: 675,256

[22] Filed: Apr. 8, 1976

[51] Int. Cl.[2] ..... A61G 11/00

[52] U.S. Cl. ..... 312/1; 21/61; 23/259; 128/1 B; 220/358; 312/320

[58] Field of Search ..... 21/61; 23/259, 292; 128/1 R, 1 B; 312/1, 320; 223/111; 16/124; 220/358, 378; 119/35

[56] References Cited

U.S. PATENT DOCUMENTS

| | | | |
|---|---|---|---|
| 1,683,345 | 9/1928 | Geyer | 220/358 |
| 3,237,821 | 3/1966 | Hayne et al. | 23/259 X |
| 3,700,135 | 10/1972 | Collier | 220/200 X |
| 3,907,389 | 9/1975 | Cox et al. | 128/1 B X |
| 4,010,588 | 3/1977 | Eisert | 128/1 B X |

*Primary Examiner*—Joseph Scovronek
*Attorney, Agent, or Firm*—Jack E. Dominik

[57] ABSTRACT

A glove port and insert is disclosed useful on a chamber such as an isolette or anaerobic glove box or isolator. A collar is provided in the side wall of the chamber and the sleeve portion of the glove is passed over the periphery of the collar and clamped in place. Separately and interiorly of the chamber, there is provided an insert which has a periphery complementary to that of the interior of the collar, and a gasket at its outer portion. In the glove port and insert disclosed, the collar is circular, and so is the periphery of the insert. The gasket is crescent shaped in cross-section, and the periphery of the insert is conformed with a channel defining a pair of gluing rings onto which the gasket is secured. A handle is provided on one face of the insert so that the user can grasp the same while the hand is still in the glove, remove the glove sleeve to its "inside-out" configuration, and at the same time pull the insert into the interior of the collar thereby sealing the same from contaminants.

4 Claims, 5 Drawing Figures

GLOVE PORT AND INSERT

FIELD OF INVENTION

The present invention relates primarily to medical equipment, and more particularly chambers which are provided with a controlled interior atmosphere. In an anaerobic workbench, for example, the oxygen content is normally kept at a level below 50 parts per million. On the other hand, in an isolator, a sterile environment can be maintained in the interior, and also barriers are provided so that contaminants generated by a patient in the isolator, or exterior to it, are insulated each from the other. Glove ports as such have been used on flexible chambers, as well as iris-type collars or cuffs, which are adjustable so that the bare hand can pass interiorly of the chamber, and then be isolated.

SUMMARY OF THE PRIOR ART

The prior art as pointed out, relates primarily to anaerobic workbenches, isolators, isolettes and other barrier systems in the medical field where glove means are provided for an operator to manipulate his hands interiorly of the chamber. Such gloves are usually secured on the outside of the chamber at an opening. Alternatively, the iris type collars may be employed.

SUMMARY

The present invention contemplates a closed chamber and a glove port and insert for the same including a collar on a wall of the chamber, and a glove having a sleeve portion which is positionable on the collar for being clampingly secured to the same. An insert having a periphery complementary with the interior of the collar is also provided having a handle so that it can be grasped, and a peripheral gasket which is snugly and yieldably engaged with the interior of the collar when the glove is out of use. Desirably, but not exclusively, the collar is circular and so is the insert. The gasket can be of a crescent shape cross-section, and cooperate with an undercut on the periphery of the insert in such a manner that when compressed, a significant flat surface is pressed against the interior of the collar.

One of the principal objects of the present invention is to provide a glove port and insert which serve as a substantial barrier against the ingress and egress from a chamber of contaminants of any sort.

In addition, the glove port inserts serve to protect the glove from any chewing by laboratory animals thus ensuring the imperforate air barrier quality of the gloves.

A further object of the present invention is to provide an insert for a glove port which, when positioned interiorly of the collar which supports the glove, will permit the replacement of a glove without disturbing the environment in the interior of the chamber.

Still another object of the present invention is to provide a glove port and insert in which the insert can be readily manipulated by the operator to position the same with its peripheral gasket in compressive relationship with the interior of a collar which supports the sleeve portion of the glove.

Still another object of the present invention is to provide a glove port and insert which are significantly effective as a barrier to contaminants, and which does not substantially add to the cost of the chamber upon which the glove port and insert is mounted.

THE DRAWINGS

Further objects and advantages of the present invention will become apparent as the following description of an illustrative embodiment proceeds, taken in conjunction with the accompanying drawings in which.

DESCRIPTION OF A PREFERRED EMBODIMENT

Figure 1:
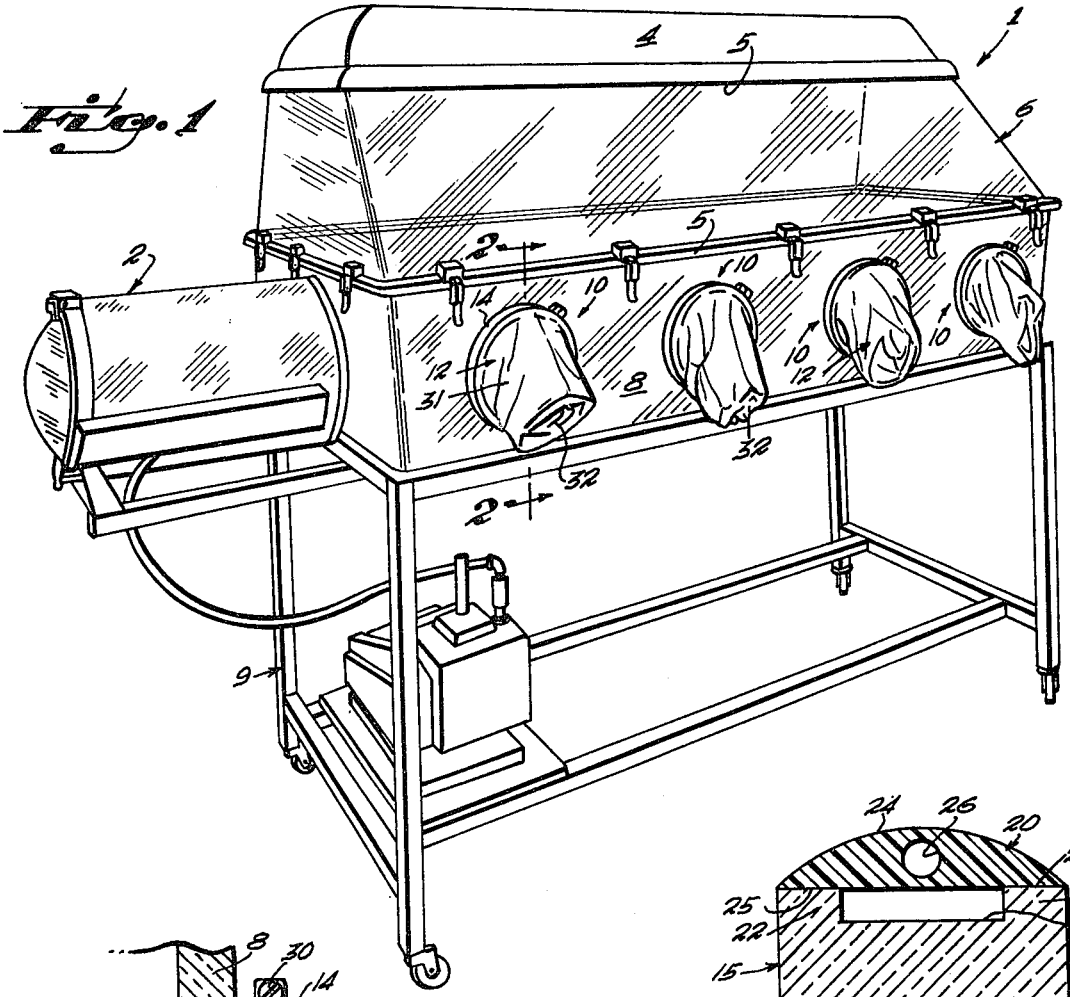
FIG. 1 is a perspective view of an anaerobic workbench or chamber having four glove ports on one side wall.

The utility of the subject glove port 10 is illustrated in FIG. 1 where it is employed on an anaerobic workbench 1. The anaerobic workbench 1 has an airlock 2 at one end. The anaerobic workbench top 4 is hinged thereto, and is clamped in place to the underneath portion or base by means of clamps and secured in airtight relationship by a seal 5, which seals the area between the base 6 and the top 4. Wall portions 8 surround the anaerobic workbench 1, and the same is supported on a stand 9.

The glove ports 10 are four in number along one side of the anaerobic workbench 1 as disclosed.

Figure 2:
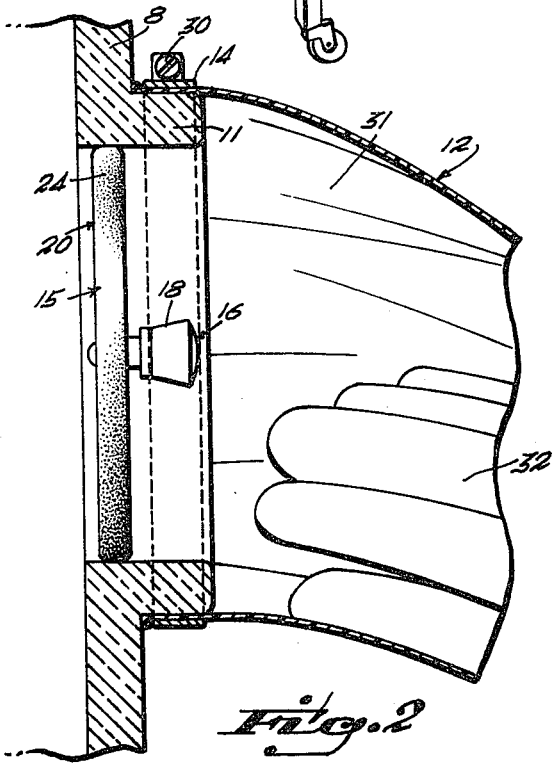
FIG. 2 is an enlarged transverse sectional view taken through the interior portion of a glove port with the insert in place substantially along section line 2—2 of FIG. 1.
Figure 5:
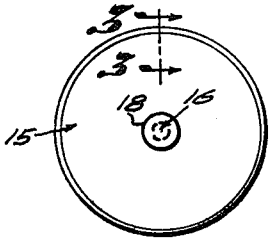
FIG. 5 is a front elevation of the insert showing the handle portion mounted in the center thereof.

Turning now to FIG. 2 which is a transverse sectional view taken through one of the glove ports of the anaerobic workbench 1 in FIG. 1, it will be seen that provision is made for a collar 11, which is permanently affixed to the side wall 8. A glove 12 having a sleeve portion 31 and finger portion 32 is clampingly engaged by its sleeve portion to the collar 11 by means of a clamp 14. Even the best of gloves 12, whether made of neoprene or other materials, can "breathe". It is to block this breathing action, and also permit for the replacement of gloves that the insert 15 is provided. In this instance the insert 15 is circular in configuration. The same is provided with a handle 16 having a hand grip portion (see FIG. 5) 18.

Figure 3:
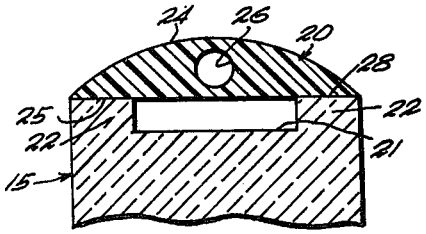
FIG. 3 is an enlarged transverse sectional view of the periphery of the insert taken substantially along section line 3—3 of FIG. 5.
Figure 4:
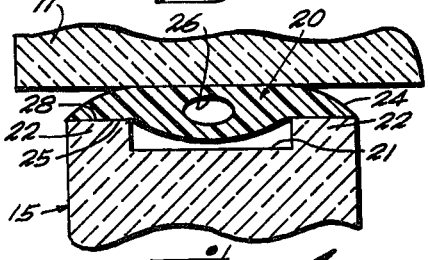
FIG. 4 is a view sequential to that of FIG. 3 and substantially the same scale, but showing the gasket portion in its operative relationship with the collar of the glove port, such as shown in the upper left-hand portion of FIG. 2.

The periphery of the insert 15 is provided with a gasket 20. The configuration of the gasket 20 is best shown in FIG. 3, where it will be seen that a crown 24 is provided at the top and a flat 25 at the bottom. The flat 25, in turn, is preferably glued to the side rings 22 which are defined by the undercut 21. In addition, to provide for a uniform flat compressive relationship between the crown 24 of the gasket 20 on the interior of the collar 11, a hollow portion 26 is formed into the gasket 20. Upon positioning, which is normally done by a cocking or tilting or canting action, when the gasket 20 is finally secured in place it crushes into the configuration as shown in FIG. 4, with the hollow portion 26 taking on an elliptical configuration with the major axis of the ellipse across the undercut 21, and the minor axis along a radius of the insert 15, again all as shown in FIG. 4. The glue joint 28 between the flat 25 and the side rings 22 is adequate to provide the necessary seal to the insert 15, along with the seal provided by the crushed face of the crown 24 against the interior of the collar. Indeed, in addition thereto, when the crescent shaped gasket 20 is compressed as shown in FIG. 4, the central portion of the flat 25 bends and fills into the undercut 21, thereby further defining a barrier against contaminants passing through the area between the insert 15 and the collar 11.

In the event a glove should become torn either by cutting with a sharp instrument, or due to wear, the glove can be readily replaced when the insert 15 is in position by turning the clamp screws 30 on the clamp 14, removing the sleeve portion 31 from the collar 11, and positioning another glove 12 in place. The clamp 14 is then repositioned around the sleeve portion 31 of the glove, and at all times the interior of the chamber is sealed from any contaminants coming in from outside by means of the insert 15. It will be appreciated, of course, that where a slight positive pressure is applied interiorly of the chamber, the collar 11 may be tapered slightly so that a self-energizing and self-sealing effect takes place. Normally this is not required, however, since the compressive relationship between the seal 20 and the interior of the collar 11 will accomplish adequate sealing.

In review it will be seen that a glove port and insert 10, 15 has been disclosed which permits a barrier to be positioned in the glove port when the glove is out of use. In addition, the insert 15 permits the replacement of the glove 12 without disturbing the environment inside the chamber on which the port is mounted.

Although particular embodiments of the invention have been shown and described in full here, there is no intention to thereby limit the invention to the details of such embodiments. On the contrary, the invention is to cover all modifications, alternatives, embodiments, usages and equivalents of a glove port and insert as fall within the spirit and scope of the invention, specification and the appended claims.

What is claimed is:

1. A glove port and insert for a closed chamber having side walls comprising, in combination, a closed chamber, glove port openings in said closed chamber side walls, a collar on a wall of said chamber surrounding a glove port opening having an outer and inner surface, a glove having a sleeve portion positionable on said collar on its outer surface, clamping means for securing said sleeve portion of said glove to said collar outer surface, an insert having a periphery complementary with the interior surface of said collar, handle hold means for gripping said insert while the operator's hand is in said glove, an undercut defining flanking rings around the periphery of the insert, a crescent shaped gasket secured to said flanking rings which is compressible into the groove defined by the flanking rings to which the gasket is secured, whereby the insert may be positioned by the operator wearing the glove into the port and sealingly secured to the same by the compressive action of the interior portion of the collar against the gasket when the same is compressed by its engagement with the interior of the collar.

2. In the glove port and insert of claim 1, said collar being circular, and, said insert being circular whereby said insert may be tilted prior to placement.

3. In the glove port and insert of claim 1, said gasket means having a hollow central portion whereby a flat contact is established against the interior of the collar.

4. In the glove port and insert of claim 1, said clamping means comprising a band having at least one screw clamp for tightening the same.

* * * * *